US007488204B2

(12) United States Patent
Hsu

(10) Patent No.: US 7,488,204 B2
(45) Date of Patent: Feb. 10, 2009

(54) TELESCOPIC AND ADJUSTABLE ELECTRICALLY CONDUCTIVE DEVICE AND SOCKET DEVICE

(75) Inventor: Jung-Hui Hsu, Taipei Hsien (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/849,570

(22) Filed: Sep. 4, 2007

(65) Prior Publication Data

US 2008/0009157 A1 Jan. 10, 2008

Related U.S. Application Data

(63) Continuation-in-part of application No. 11/517,413, filed on Sep. 8, 2006, now Pat. No. 7,374,423.

(30) Foreign Application Priority Data

Jul. 7, 2006 (TW) ..... 95212032 U
Jun. 8, 2007 (TW) ..... 96120863 A

(51) Int. Cl.
*H01R 13/60* (2006.01)

(52) U.S. Cl. ..... 439/535; 439/502; 439/106

(58) Field of Classification Search ..... 439/535, 439/502

See application file for complete search history.

(56) References Cited

U.S. PATENT DOCUMENTS

2007/0178756 A1 * 8/2007 Schriefer et al. ..... 439/535

* cited by examiner

*Primary Examiner*—Truc T Nguyen
(74) *Attorney, Agent, or Firm*—Rosenberg, Klein & Lee

(57) ABSTRACT

A telescopic and adjustable electrically conductive device includes a first electrically conductive piece and a second electrically conductive piece. The second electrically conductive piece is movable contacted with the first electrically conductive piece. The present invention further provides a socket device including a socket and at least two electrically conductive devices. The socket comprises a base and a plurality of socket bodies and they are combined together in a slidable manner. The electrically conductive device comprises a first electrically conductive piece, a second electrically conductive piece and a plurality of contacting pieces. The contacting pieces movable contact with the second electrically conductive piece. The first electrically conductive piece is inside the base, and the second electrically conductive piece is inside the base and the socket bodies. The electrically conductive device and the socket device of the present invention are telescopic and adjustable, simple in structure, easy to assemble and inexpensive.

13 Claims, 6 Drawing Sheets

TELESCOPIC AND ADJUSTABLE ELECTRICALLY CONDUCTIVE DEVICE AND SOCKET DEVICE

CROSS-REFERENCE TO RELATED APPLICATIONS

This application is a Continuation-in-Part of application Ser. No. 11/517,413, filed on 8 Sep. 2006, and entitled CONDUCTING STRIP FOR CONNECTION DEVICE, and which claimed priority from Taiwanese Application No. 95212032, filed Jul. 7, 2006.

BACKGROUND OF THE INVENTION

1. Field of the Invention

The present invention relates to a telescopic and adjustable electrically conductive device and a socket device, and in particular to an electrically conductive device and a socket device that is telescopically adjustable and can conduct electricity.

2. Description of Prior Art

A conventional socket is primarily used for electrically connecting various electrical appliances to a power supply. With the increase in the number of electrical appliances owned by most people, sockets are used more and more frequently. Therefore, manufacturers continue to improve sockets so as to provide more and more functions.

Since existing multiple-hole sockets have a fixed length, the pitches between the inserted holes on sockets are also of a fixed dimension. Therefore, it is impossible to adjust the length of the socket and the pitch of the inserted holes according to practical demands. As a result, when a larger plug is inserted into the insertion holes of a socket, it will often interfere with a neighboring plug, making it impossible to insert both plugs.

The interior of the socket is provided with an electrically conductive device that is formed of electrical-conductive pieces (also referred to as copper pieces or terminals), thereby allowing the plug to conduct electricity. If the length of the socket is adjustable, the electrically conductive device also has to be telescopic and adjustable so that the length of the socket and the pitch of the insertion holes can be adjusted telescopically. Therefore, it is an important issue for the socket industry to design an improved electrically conductive device that is telescopic and adjustable, simple in structure, easy to assemble, and inexpensive.

Therefore, in view of this, the inventor proposes the present invention to overcome the above problems based on his expert experience and deliberate research.

SUMMARY OF THE INVENTION

The primary object of the present invention is to provide a telescopic and adjustable electrically conductive device and a socket device, which is telescopic and adjustable, simple in structure, easy to assemble, and inexpensive.

In order to achieve the above objects, the present invention provides a telescopic and adjustable electrically conductive device that includes a first electrically conductive piece and a second electrically conductive piece. The second electrically conductive piece is brought into movable contact with the first electrically conductive piece, thereby adjusting the length of the electrically conductive device telescopically.

The present invention provides a telescopic and adjustable socket device, which includes: a socket comprising a base and a plurality of socket bodies, and at least two electrically conductive devices. The base and each of the socket bodies being provided with an insertion hole respectively. The base and the socket bodies are combined together in a slidable manner so as to adjust the length thereof telescopically. Each of the conductive devices comprises a first electrically conductive piece, a second electrically conductive piece and a plurality of contacting pieces. The second electrically conductive piece is brought into movable contact with the first electrically conductive piece. The contacting pieces are brought into movable contact with the second electrically conductive piece. The first electrically conductive piece is provided in the base, and the second electrically conductive piece is provided in the base and the socket bodies. The contacting pieces are provided in the base and the socket bodies respectively. The contacting pieces correspond to the insertion holes of the base and the socket bodies respectively.

The present invention has the following advantages. Since the first electrically conductive piece of the electrically conductive device of the present invention is brought into movable contact with the second electrically conductive piece, the first electrically conductive piece and the second electrically conductive piece can move respectively with each other to change the whole length thereof. Therefore, they can be applied to a socket to adjust the length of the socket telescopically. Further, the distance between the base and the socket bodies and the pitch of the insertion holes can be adjusted so that a plug can be inserted into the insertion holes of the socket smoothly. Further, since the electrically conductive device of the present invention is constituted of the first electrically conductive piece and the second electrically conductive piece, its structure is simple, and it is easy to assemble, thereby reducing its cost efficiently by necessitating less assembly costs.

In order to better understand the characteristics and the technical contents of the present invention, a detailed description thereof will be made with reference to the accompanying drawings. However, it should be understood that the drawings and the description are illustrative and not used to limit the scope of the present invention.

DETAILED DESCRIPTION OF THE INVENTION

Figure 1:
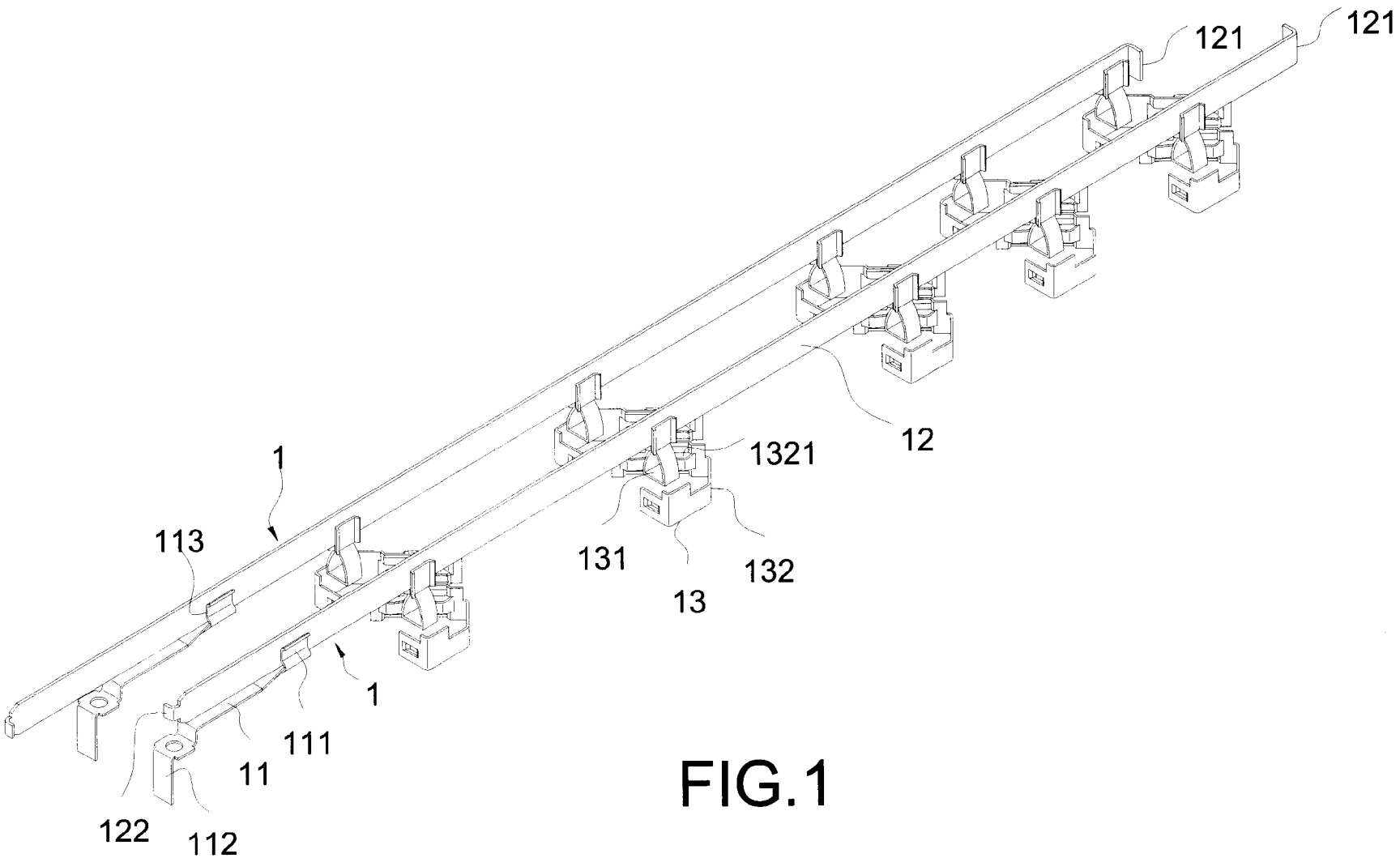
FIG. 1 is a perspective view showing the telescopic and adjustable electrically conductive device of the present invention.
Figure 2:
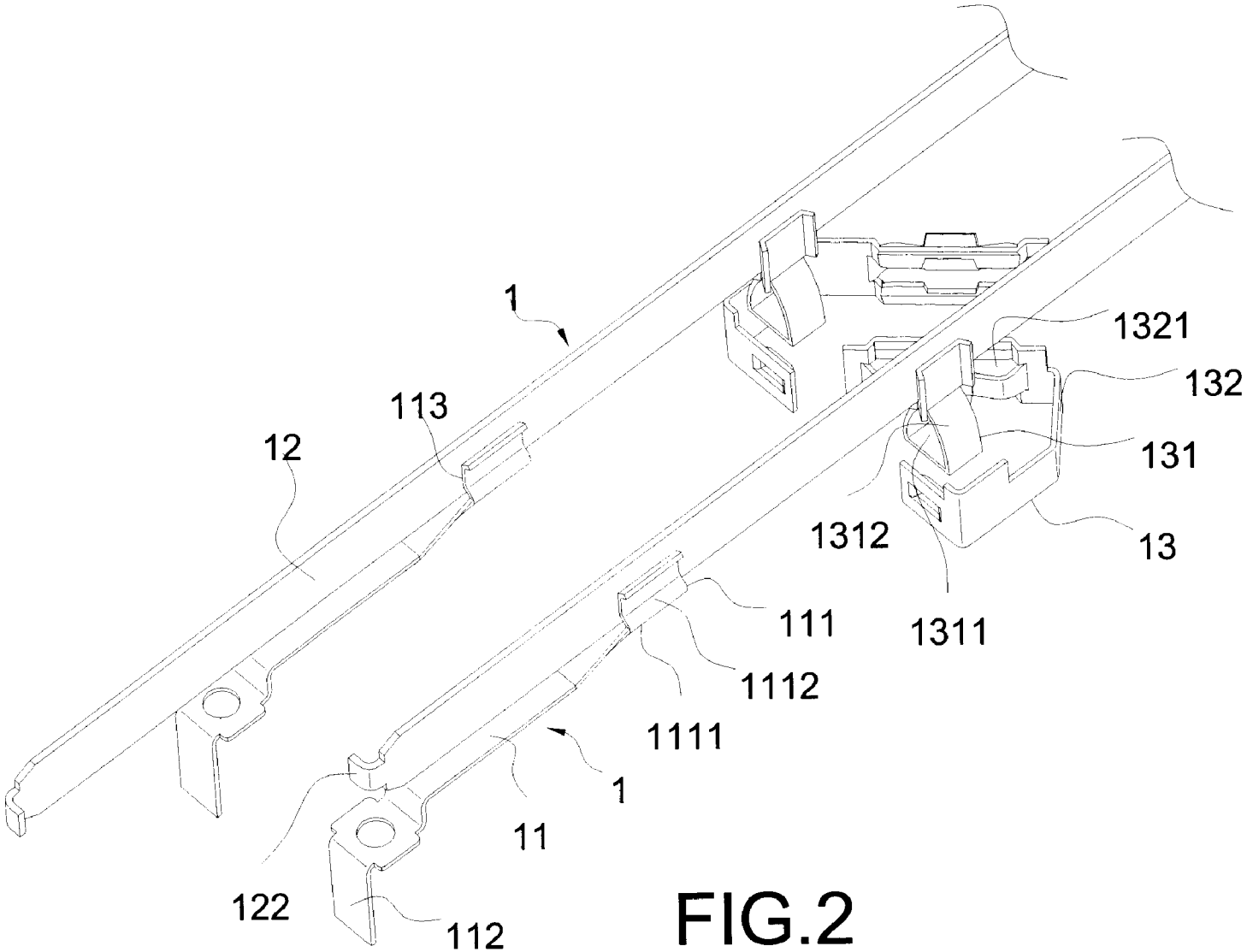
FIG. 2 is a perspective view showing the details of a portion of the telescopic and adjustable electrically conductive device of the present invention.
Figure 3:
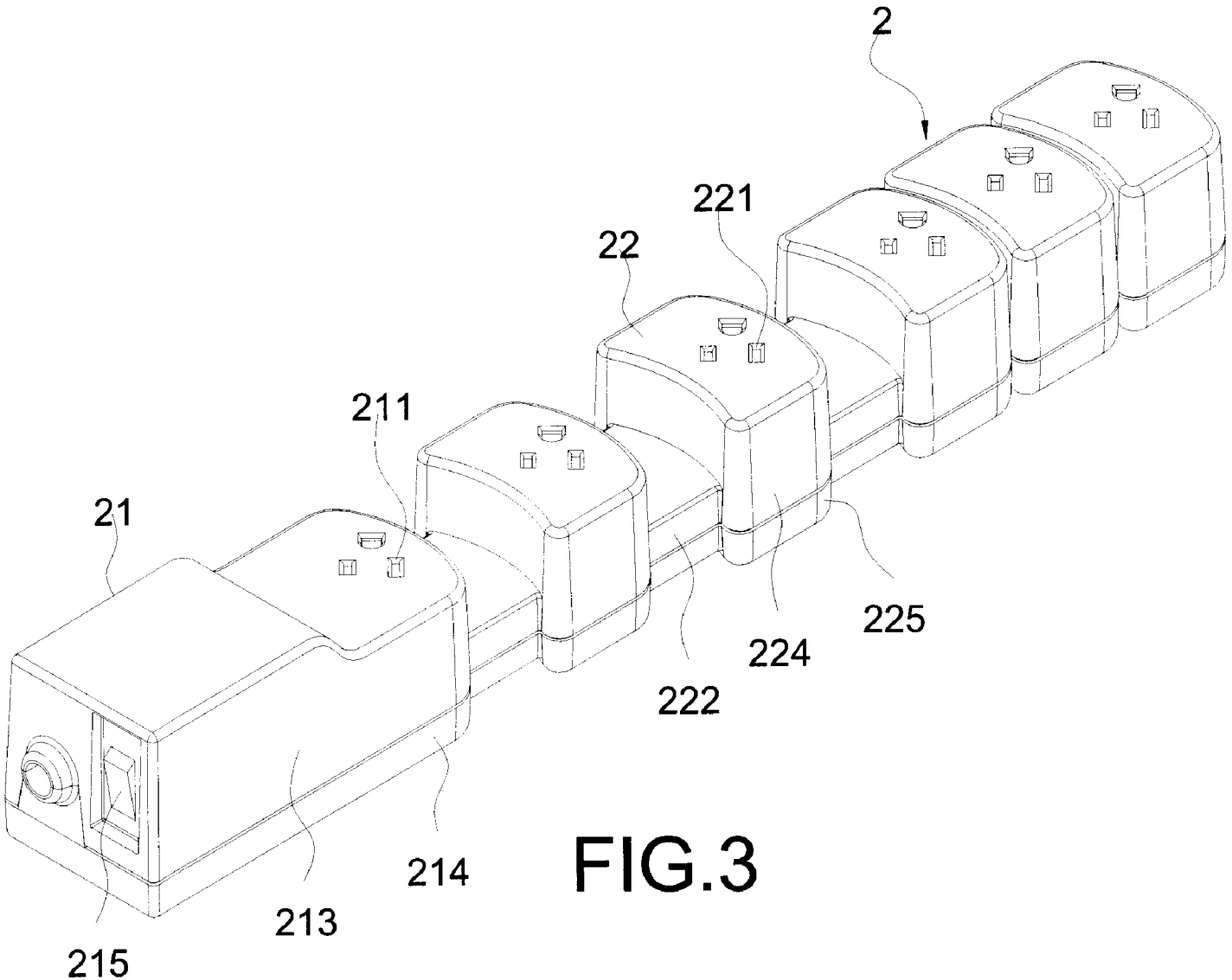
FIG. 3 is a perspective view showing the telescopic and adjustable socket of the present invention.
Figure 4:
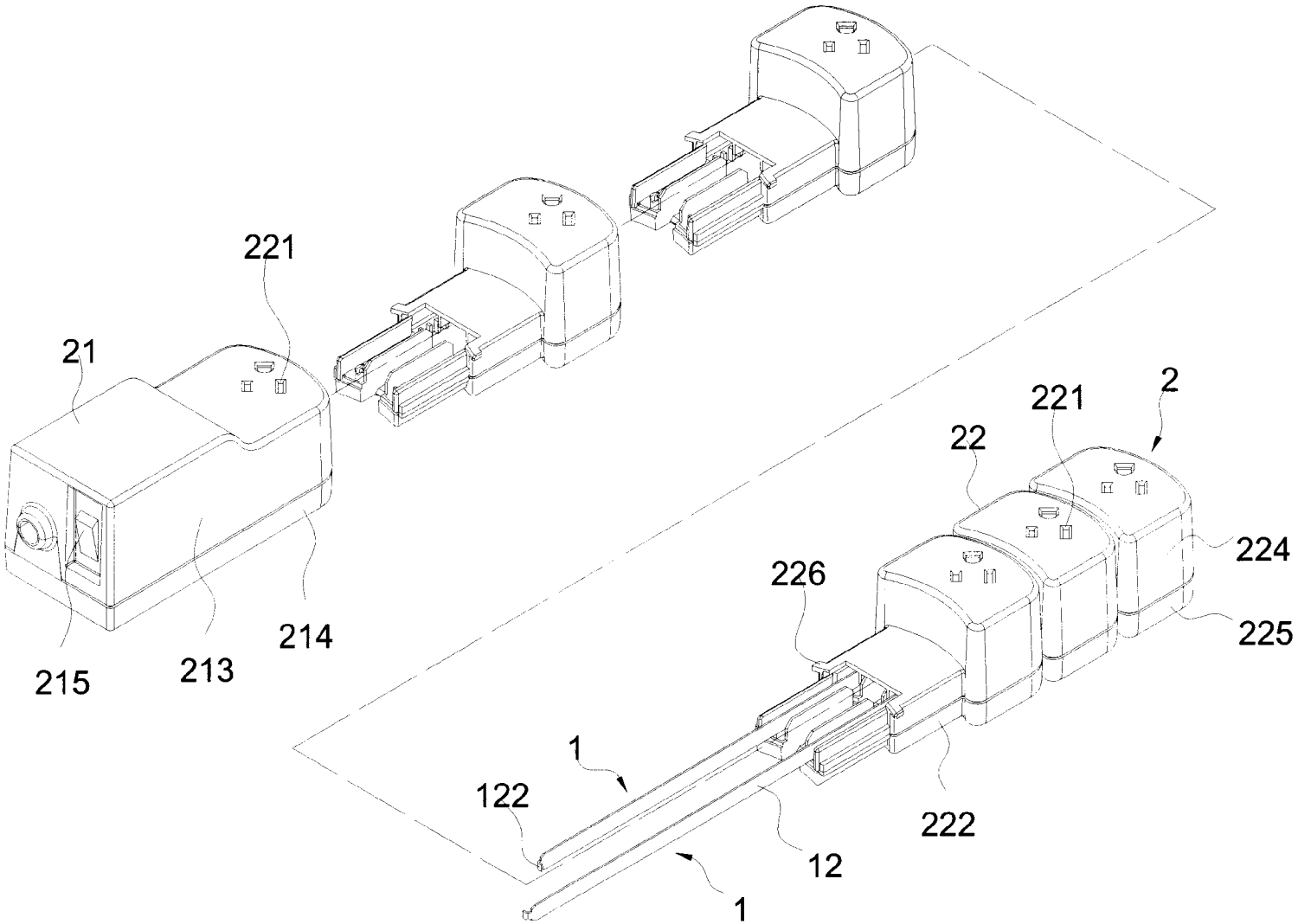
FIG. 4 is an exploded perspective view showing the telescopic and adjustable socket of the present invention.
Figure 5:
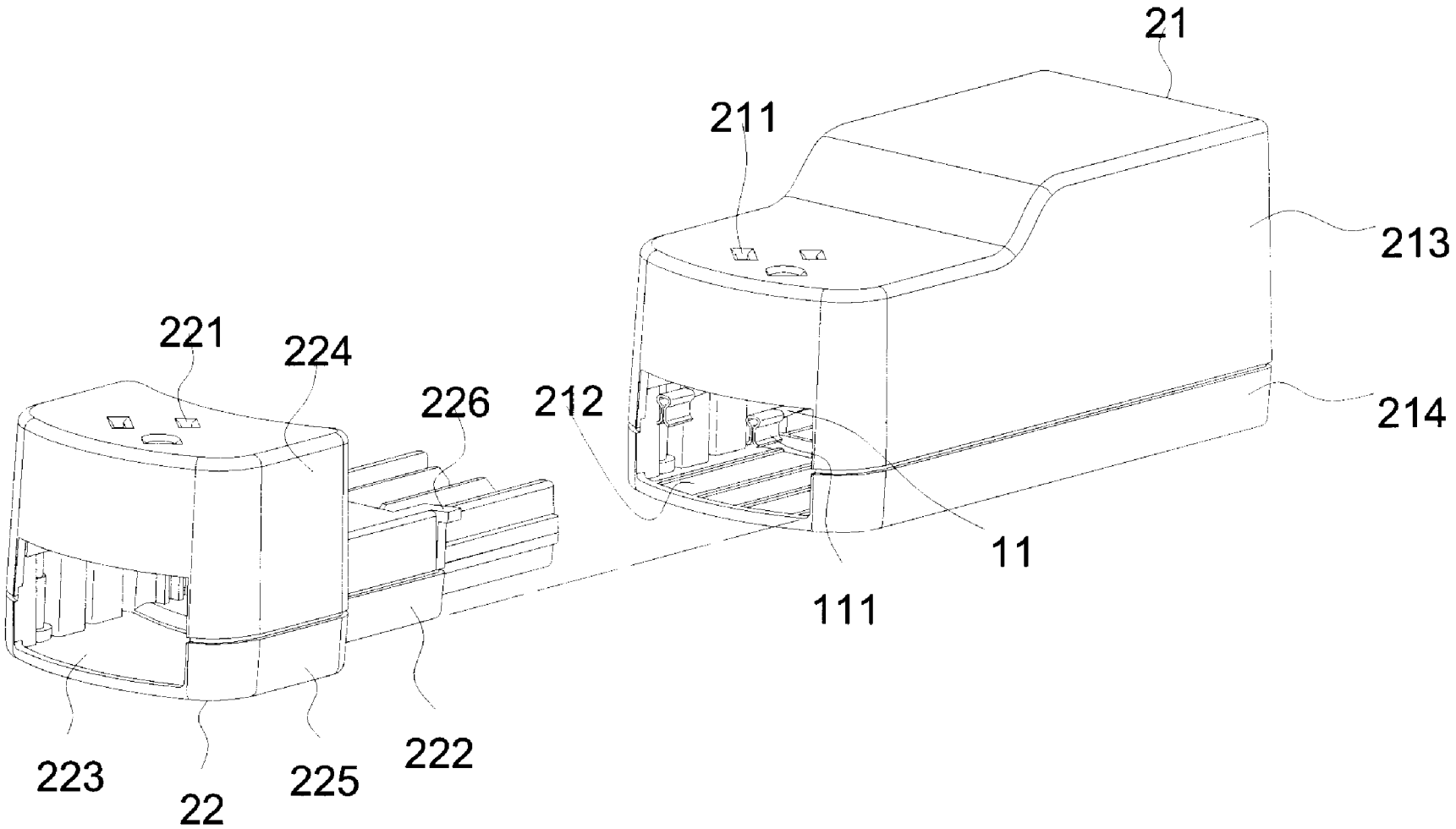
FIG. 5 is a perspective view showing the base and a socket body of the present invention.
Figure 6:
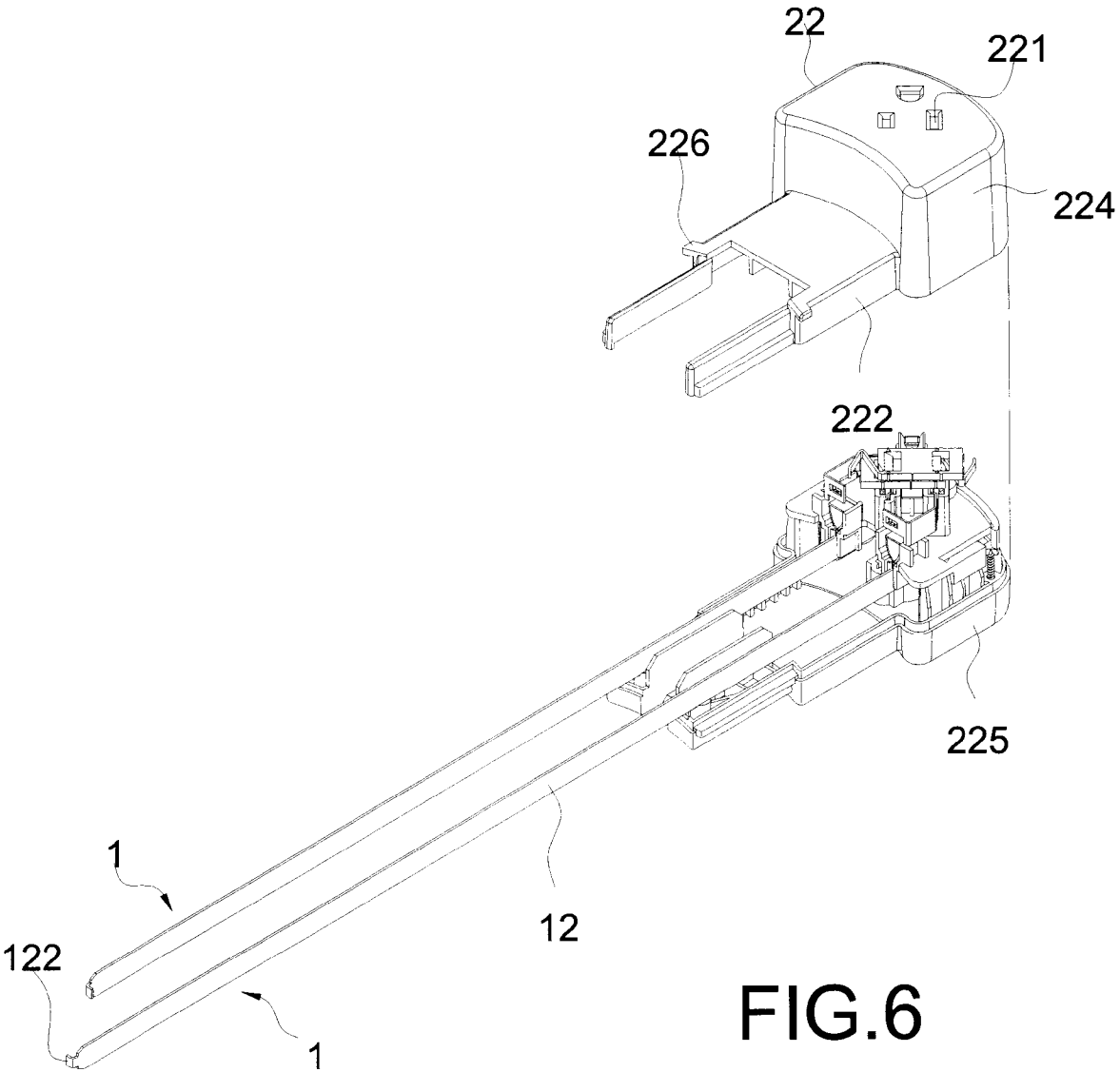
FIG. 6 is a perspective view showing the electrically conductive device and a socket body of the present invention.

Please refer to FIG. 1 and FIG. 2. The present invention provides a telescopic and adjustable electrically conductive device. In the present embodiment, a pair of electrically conductive devices 1 is provided in a socket 2 (FIG. 3). The length of the socket 2 can be adjusted telescopically, thereby changing the pitch between the insertion holes 211, 221 on the socket 2.

Each of the electrically conductive devices 1 includes a first electrically conductive piece 11 and a second electrically conductive piece 12. The first electrically conductive piece 11 is made of a copper piece and formed into an elongated piece. The first electrically conductive piece 11 is provided in the socket 2 and one end thereof is formed with a first clamping portion 111. The first clamping portion 111 has a bottom plate 1111 and side plates 1112 that are bent and extend upwardly from both sides of the bottom plate 1111. The two side plates 1112 of the first clamping portion 111 can clamp the second electrically conductive piece 12 therebetween.

The other end of the first electrically conductive piece 11 is bent to form a wiring portion 112 that is soldered with wire to introduce a power supply. The first clamping portion 111 is formed with a stopping surface 113 at one end thereof adjacent to the wiring portion 112, thereby stopping the second electrically conductive piece 12.

The second electrically conductive piece 12 is made of a copper piece and is formed into an elongated piece. The second electrically conductive piece 12 is provided in the socket 2. The length of the second electrically conductive piece 12 is larger than that of the first electrically conductive piece 11. The first clamping portion 111 of the first electrically conductive piece 11 clamps the second electrically conductive piece 12 elastically, so that the first electrically conductive piece 11 and the second electrically conductive piece 12 contact each other to electrically connect. Further, the first electrically conductive piece 11 is brought into movable contact with the second electrically conductive piece 12 so that the first electrically conductive piece 11 and the second electrically conductive piece 12 can move respectively with each other to correspond to the telescopic movement of the socket 2, thereby changing the whole length thereof.

Both ends of the second electrically conductive piece 12 are bent to form a driving portion 121 and a protrusion 122. The driving portion 121 is used to drive the second electrically conductive piece 12 to move so that the first electrically conductive piece 11 and the second electrically conductive piece 12 can move respectively with each other to change the whole length thereof. Further, the second electrically conductive piece 12 is pushed to move away from the first electrically conductive piece 11 so that the protrusion 122 abuts against the stopping surface 113 when the first electrically conductive piece 11 and the second electrically conductive piece 12 are adjusted to the largest length, thereby stopping the second electrically conductive piece 12 from being detached from the first electrically conductive piece 11.

According to practical demands, the above-mentioned first electrically conductive piece 11 and the second electrically conductive piece 12 can be connected to a plurality of contacting pieces 13 that is electrically connected with plugs. The contacting pieces 13 are provided in the socket 2. The number and the positions of the contacting pieces 13 correspond to those of the insertion holes 211, 221 of the socket 2. Each of the contacting pieces 13 comprises a second clamping portion 131 and a contacting portion 132. The second clamping portion 131 is made of a copper piece. Each of the second clamping portions 131 has a bottom plate 1311 and side plates 1312 that are bent and extend upwardly from both sides of the bottom plate 1311. The two side plates 1312 of the second clamping portion 131 can clamp the second electrically conductive piece 12 therebetween.

The contacting portion 132 is made of a copper piece. One end of the contacting portion 132 is formed with an elongated insertion hole 1321 that allows the pins of the plug to be inserted therein and thus to be electrically connected therewith. The second clamping portion 131 and the contacting portion 132 are electrically connected with each other via leads so that the power supply can be supplied to the contacting portion 132 via the second clamping portion 131. The second clamping portion 131 of the contacting piece 13 clamps the second electrically conductive piece 12 elastically so that the second electrically conductive piece 12 is brought into contact with the contacting pieces 13 to electrically connect. Further, the second electrically conductive piece 12 is brought into movable contact with the contacting pieces 13. Via the above arrangement, the telescopic and adjustable electrically conductive device of the present invention can be formed.

Please refer to FIGS. 3 to 6. The electrically conductive device 1 of the present invention is mounted in the socket 2. The socket 2 is constructed so that it can be telescopically adjusted at multiple stages. The socket 2 comprises a base 21 and a plurality of socket bodies 22. The base 21 comprises an upper casing 213 and a lower casing 214. The upper casing 213 and the lower casing 214 are combined with each other to form an integral unit by means of locking, screwing, or a supersonic process. The interior of the base 21 is provided with appropriate circuit units (not shown). A switch 215 is provided on the base 21. The switch 215 is electrically connected to the electrically conductive device 1. Each of the socket body 22 comprises an upper casing 224 and a lower casing 225. The upper casing 224 and the lower casing 225 are combined with each other to form an integral unit by means of locking, screwing, or a supersonic process.

The base 21 and each of the socket bodies 22 are provided thereon with an insertion hole 211, 221 respectively. The specification of the insertion holes 211, 221 is not restricted, but can be any kind of insertion hole according to practical demands. A block-like sliding portion 222 protrudes from one side of each of the socket bodies 22. The base 21 and the other side of the socket body 22 have corresponding sliding grooves 212, 223 respectively.

The sliding portion 222 of the socket body 22 is slidably engaged in the sliding groove 223 of the neighboring socket body 22. The sliding portion 222 of the leftmost socket body 22 is slidably engaged in the sliding groove 212 of the base 21 so that the base 21 and the socket bodies 22 are combined together to form an integral unit in a slidable manner. Therefore, by pushing, the base 21 and the socket bodies 22 can be extended to form a larger length or retracted to form a shorter length. In this way, the pitch between the base 21 and the socket bodies 22 can be adjusted individually.

Both sides of the sliding portion 222 of the socket body 22 are provided with a locking piece 226 respectively. When the base 21 and the socket bodies 22 extend to the predetermined largest length, the locking pieces 226 abut against the inner walls on both sides of the sliding grooves 212, 223 in the vicinity of the opening, thereby preventing the sliding portion 222 of the socket body 22 from being detached from the sliding grooves 212, 223.

The above first electrically conductive piece 11 is fixed in the base 21 of the socket 2. The second electrically conductive piece 12 is provided in the base 21 and the socket bodies 22. The driving portion 121 of the second electrically conductive piece 12 is fixed in the rightmost socket body 22 of the socket 2. In this way, when the base 21 and the socket bodies 22 are pushed to adjust their length telescopically, the driving portion 121 drives the second electrically conductive piece 12 so that the first electrically conductive piece 11 and the second electrically conductive piece 12 can move respectively with each other to change the whole length. Via the clamping of the first clamping portion 111, the second electrically conductive piece 12 can be electrically connected with the first electrically conductive piece 11. As a result, the electrical connection between the first electrically conductive piece 11 and the second electrically conductive piece 12 can be maintained at all times so that the power supply can be supplied to the first electrically conductive piece 11 and the second electrically conductive piece 12.

The above contacting pieces 13 are fixed in the base 21 and the socket bodies 22 respectively. The contacting portions 132 of the contacting pieces 13 correspond to the insertion holes 211, 221 of the base 21 and the socket bodies 22 respectively so that the pins of the plugs can be electrically connected with the contacting portions 132 of the contacting pieces 13 when inserted into the insertion holes 211, 221. The contacting piece 13 electrically connects in a manner that the second clamping portion 131 clamps the second electrically conductive piece 12. Therefore, the electrical connection between the second electrically conductive piece 12 and the contacting pieces 13 can be maintained at all times so that the power supply can be supplied to the contacting pieces 13.

In the electrically conductive device 1 of the present invention, the first electrically conductive piece 11 and the second electrically conductive piece 12 are brought into movable contact with each other by means of the elastic clamping of the clamping portion 111. The first electrically conductive piece 11 and the second electrically conductive piece 12 can move respectively with each other to change the whole length thereof. Therefore, the electrically conductive device 1 can be applied to the socket 2 so that the length of the socket 2 can be adjusted telescopically. Further, the pitch between the base 21 and the socket bodies 22 and the pitch between the insertion holes 211, 221 can be adjusted according to the practical demands (FIG. 3) so that the plugs can be inserted into the insertion holes 211, 221 of the socket 2 smoothly.

Furthermore, in the electrically conductive device 1 of the present invention, the first electrically conductive piece 11 and the second electrically conductive piece 12 are brought into movable contact each other to electrically connect. Also, they can move respectively with each other to change the whole length thereof. Therefore, the present invention is simple in structure and easy to assemble, thereby reducing assembly times and lowering the cost of the socket efficiently.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A telescopic and adjustable electrically conductive device, comprising:

a first electrically conductive piece, an end of the first electrically conductive piece being formed with a first clamping portion and a stopping surface; and a second electrically conductive piece, the second electrically conductive piece being brought into movable contact with the first electrically conductive piece, the first clamping portion of the first electrically conductive piece clamping the second electrically conductive piece, an end of the second electrically conductive piece being formed with a protrusion, the protrusion operable to abut against the stopping surface, thereby adjusting the length of the electrically conductive device telescopically.

2. The telescopic and adjustable electrically conductive device according to claim 1, wherein the first clamping portion has a bottom plate and side plates extending upwardly from both sides of the bottom plate.

3. The telescopic and adjustable electrically conductive device according to claim 1, wherein one end of the second electrically conductive piece is formed with a driving portion.

4. The telescopic and adjustable electrically conductive device according to claim 1, further comprising a plurality of contacting pieces, wherein the contacting pieces are brought into movable contact with the second electrically conductive piece.

5. The telescopic and adjustable electrically conductive device according to claim 4, wherein each of the contacting pieces has a contacting portion.

6. The telescopic and adjustable electrically conductive device according to claim 4, wherein each of the contacting pieces has a second clamping portion, and the second clamping portion of the contacting piece clamps the second electrically conductive piece.

7. A telescopic and adjustable socket device, comprising:

a socket comprising a base and a plurality of socket bodies, wherein the base and each of the socket bodies are provided with a group of insertion holes respectively, the base and the socket bodies are combined together in a slidable manner, thereby adjusting the length thereof telescopically; and at least two electric ally conductive devices, each comprising a first electrically conductive piece, a second electrically conductive piece and a plurality of contacting pieces, wherein the second electrically conductive piece and the first electrically conductive piece are brought into movable contact with each other, the contacting pieces are brought into movable contact with the second electrically conductive piece, the first electrically conductive piece is provided in the base, the second electrically conductive piece is provided in the base and the socket bodies, the contacting pieces are provided in the base and the socket bodies, and the contacting pieces corresponding to the insertion holes of the base and the socket bodies respectively, each of the first electrically conductive pieces being formed with a first clamping portion and a stopping surface, the first clamping portions clamp a corresponding second electrically conductive piece, one end of each second electrically conductive piece being formed with a protrusion, each protrusion being operable to abut against a corresponding stopping surface.

8. The telescopic and adjustable socket device according to claim 7, wherein one side of each of the socket bodies extends to form a sliding portion, the base and the other side of each of the socket bodies are provided with a sliding groove respectively, the sliding portions of the socket bodies are slidably engaged in the sliding grooves of the neighboring socket body and the base.

9. The telescopic and adjustable socket device according to claim 7, wherein the first clamping portion has a bottom plate and side plates extending upwardly from both sides of the bottom plate.

10. The telescopic and adjustable socket device according to claim 7, wherein one end of the second electrically conductive piece is formed with a driving portion, and the driving portion is fixed in the socket body on one end of the socket.

11. The telescopic and adjustable socket device according to claim 7, wherein each of the contacting pieces has a contacting portion, the contacting portions of the contacting pieces correspond to the insertion holes of the base and the socket bodies respectively.

12. The telescopic and adjustable socket device according to claim 8, wherein both sides of the sliding portion of the socket body are provided with a locking piece respectively, and the locking pieces abut against the inner walls on both sides of the sliding grooves.

13. The telescopic and adjustable socket device according to claim 7, wherein each of the contacting pieces has a second clamping portion, and the second clamping portion of the contacting piece clamps the second electrically conductive piece.

* * * * *